US008733460B2

(12) United States Patent
Fritz

(10) Patent No.: US 8,733,460 B2
(45) Date of Patent: May 27, 2014

(54) METHOD AND APPARATUS FOR PROVIDING A PRESSURIZED LIQUID IN THE ABSENCE OF ELECTRICITY

(76) Inventor: Robert K. Fritz, New Bloomfield, PA (US)

( * ) Notice: Subject to any disclaimer, the term of this patent is extended or adjusted under 35 U.S.C. 154(b) by 963 days.

(21) Appl. No.: 12/763,691

(22) Filed: Apr. 20, 2010

(65) Prior Publication Data

US 2010/0263881 A1 Oct. 21, 2010

Related U.S. Application Data

(60) Provisional application No. 61/170,724, filed on Apr. 20, 2009.

(51) Int. Cl.
*A62C 35/00* (2006.01)

(52) U.S. Cl.
USPC ..... 169/13; 169/5; 169/16; 417/46; 417/393; 417/395

(58) Field of Classification Search
USPC ..... 169/5, 7–9, 13, 46, 51, 16; 417/17, 46, 417/393, 395
See application file for complete search history.

(56) References Cited

U.S. PATENT DOCUMENTS

| | | | | |
|---|---|---|---|---|
| 241,000 | A | 5/1881 | Granger | |
| 533,449 | A | 2/1895 | Erwin | |
| 851,863 | A | 4/1907 | Buell | |
| 3,782,863 | A | 1/1974 | Rupp | |
| 4,419,056 | A | 12/1983 | Ege | |
| 4,854,832 | A | 8/1989 | Gardner et al. | |
| 5,055,007 | A | 10/1991 | Geddings | |
| 5,979,563 | A * | 11/1999 | Fritz | 169/5 |
| 6,190,136 | B1 * | 2/2001 | Meloche et al. | 417/395 |
| 7,517,199 | B2 * | 4/2009 | Reed et al. | 417/46 |
| 7,845,424 | B1 * | 12/2010 | Miller | 169/13 |

OTHER PUBLICATIONS

ARO Air-Operated Diaphragm Pumps—Ingersoll Rand Fluid Products, ARO Fluid Products Production Equipment Group, pp. 10-11, dated 1997.
Amtrol Pump Tank Lines, Amtrol Inc., p. 2, dated Aug. 1997.

* cited by examiner

*Primary Examiner* — Steven J Ganey
(74) *Attorney, Agent, or Firm* — Baker & Hostetler LLP

(57) ABSTRACT

An method and apparatus for disbursing a pressurized liquid in the absence of electricity are disclosed. The method and apparatus for disbursing a pressurized liquid in the absence of electricity can include a gas source, a liquid source, a liquid pressurization system, and a liquid delivery system.

12 Claims, 3 Drawing Sheets

METHOD AND APPARATUS FOR PROVIDING A PRESSURIZED LIQUID IN THE ABSENCE OF ELECTRICITY

CROSS-REFERENCE TO RELATED APPLICATIONS

This application claims priority to U.S. patent application Ser. No. 61/170,724, filed Apr. 20, 2009, the disclosure of which is hereby incorporated by reference as if set forth in its entirety herein.

This application is related by subject matter to U.S. Pat. No. 5,979,563, the disclosure of which is hereby incorporated by reference as if set forth in its entirety herein.

TECHNICAL FIELD

The present disclosure relates generally to a method and apparatus for providing a pressurized liquid, and in particular relates to a method and apparatus for providing a pressurized liquid in the absence of electricity.

BACKGROUND

Many applications demand pressurization systems that provide pressurized liquid in the event of a power outage. As one example, buildings are provided with fire sprinkler systems that provide pressurized liquids on-demand, for instance, in the event of a fire.

The water to be supplied to a fire sprinkler system is provided from a source of pressurized water. In some buildings, the municipal water supply can provide a sufficient amount of water pressure to operate a fire sprinkler system. In other buildings, the municipal water supply may not provide sufficient water pressure, or the water supply may be provided from a tank or a well, so the water must be pumped to provide sufficient water pressure.

In buildings having a low-pressure municipal water supply, a tank supply, or a well water supply, conventional fire sprinkler systems can use electric pumps to either increase the pressure of the water supply and/or to deliver water from a well to the sprinkler system. However, in such conventional electric pump systems, if the source of electricity is interrupted, the pump will no longer function. Under these circumstances, in the event of a fire, the pump will be unable to supply water with adequate pressure to the fire sprinkler system. Therefore, the operation of a fire sprinkler system that depends entirely on electricity can be affected when the fires causes a power outage or occurs during a power outage.

Accordingly, there is a need for an improved method and apparatus for providing a pressurized liquid in the absence of electricity.

SUMMARY

A method and apparatus for disbursing a pressurized liquid in the absence of electricity are disclosed. The method and apparatus for disbursing a pressurized liquid in the absence of electricity can include a gas source, a liquid source, a liquid pressurization system, and a liquid delivery system.

BRIEF DESCRIPTION OF THE DRAWINGS

The foregoing summary, as well as the following detailed description, is better understood when read in conjunction with the appended drawings. There is shown in the drawings example embodiments of various embodiments, however the present invention is not limited to the specific methods and instrumentalities disclosed. In the drawings.

DETAILED DESCRIPTION OF ILLUSTRATIVE EMBODIMENTS

The embodiments described below provide a method and apparatus for disbursing a pressurized liquid in the absence of electricity. The embodiments described below illustrate several aspects of the present invention and are not intended to be limiting. The embodiments can find utility in any environment where there is a need for a pressurized liquid in the absence of electricity.

Figure 1:
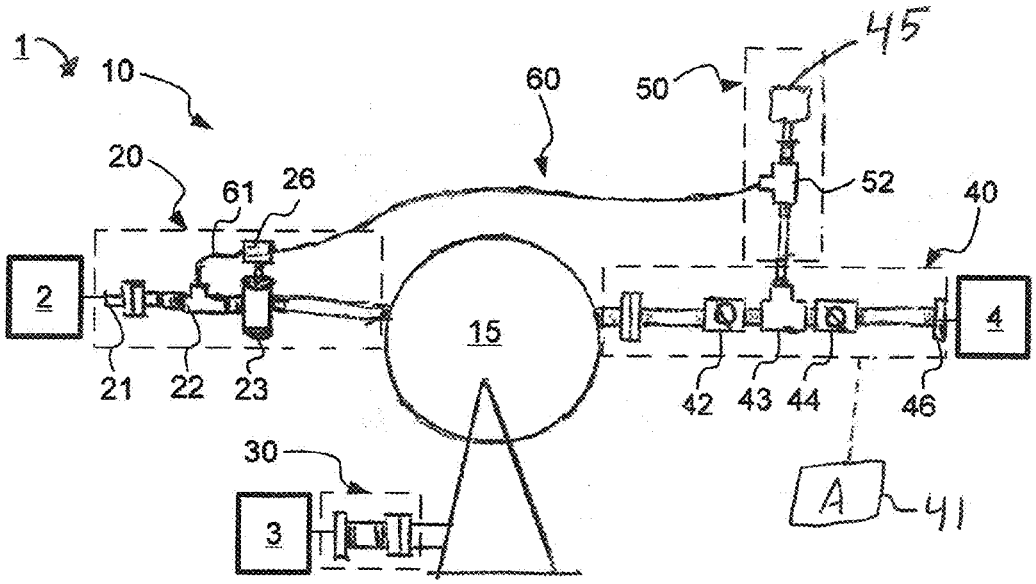
FIG. 1 is a schematic diagram of a liquid disbursement system according to a first embodiment.
Figure 2:
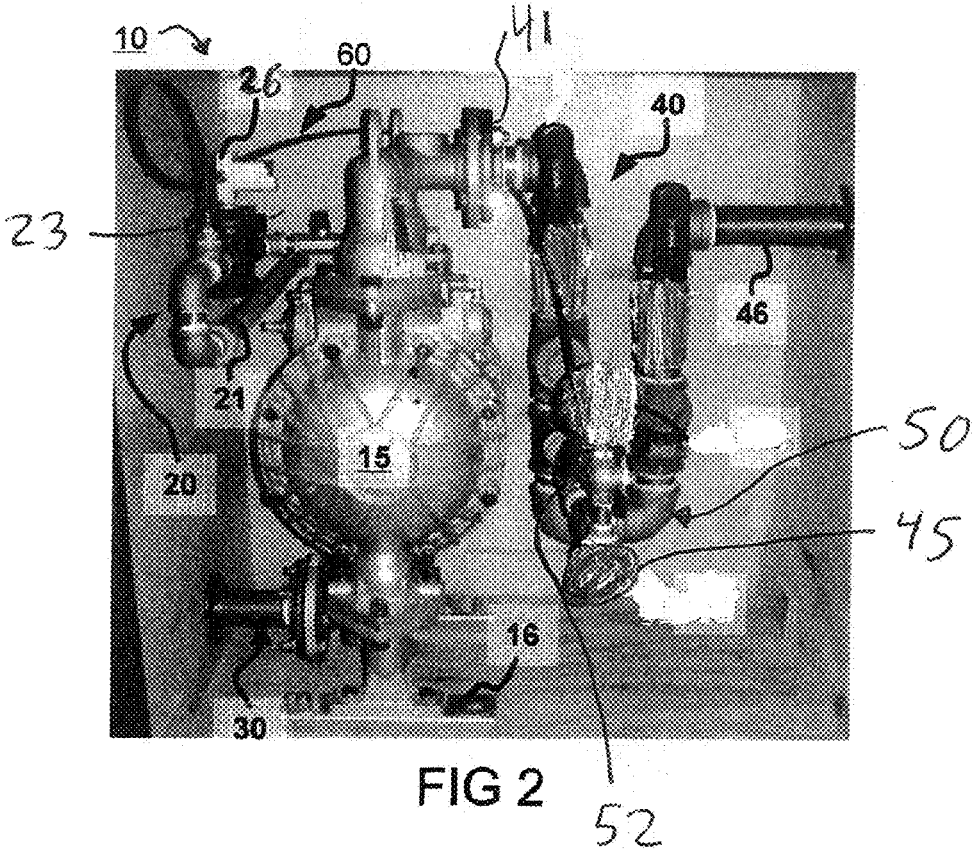
FIG. 2 is a side view of a pump system suitable for use in the liquid disbursement system depicted in FIG. 1.
Figure 3:
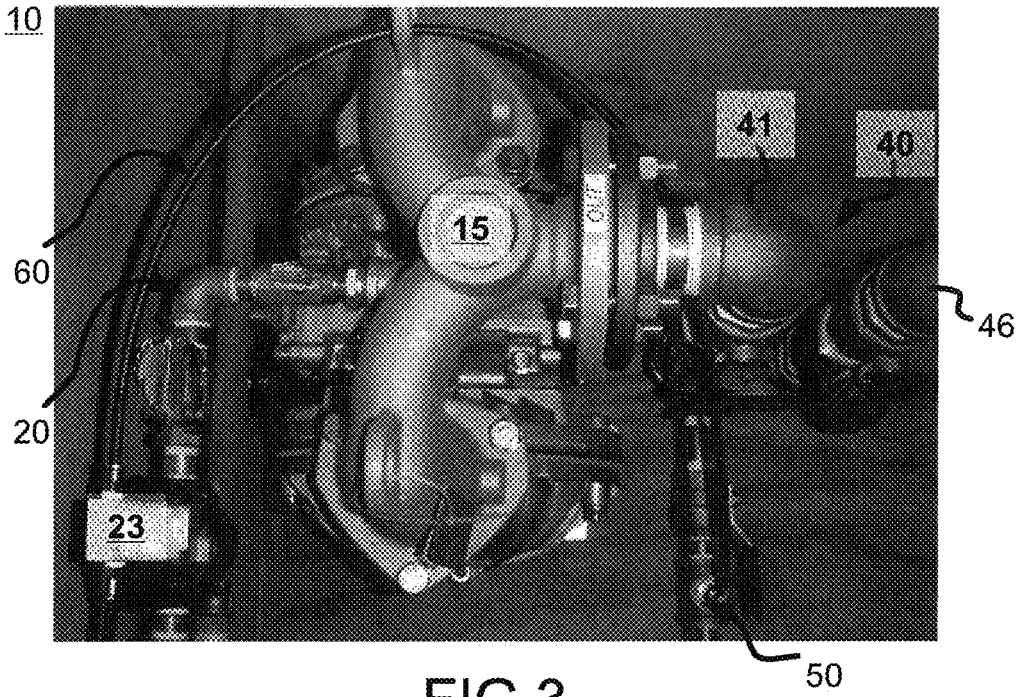
FIG. 3 is a top view of the pump system depicted in FIG. 2.

Referring to FIGS. 1-3, a liquid disbursement system 1 includes a fluid source or gas source 2, a liquid source 3, a liquid delivery system 4, and a liquid pressurization system 10. The liquid disbursement system 1 can be any system that is configured to disburse a pressurized liquid, including a water-based fire sprinkler system that can help to extinguish or control a fire in a building. The present invention is not, however, intended to be limited to a water-based fire sprinkler system unless otherwise indicated.

The gas source 2 provides power for the liquid pressurization system 10, and can be provided as any pressurized gas source, for example, a dry, non-combustible gas source. In the example embodiment of a fire sprinkler system, the gas source 2 can include one or more cylinders of compressed nitrogen gas. Although any compressed gas can be used for the gas source 2, compressed nitrogen gas can be desirable because it is inert and less prone to develop water condensation than other compressed gas sources such as compressed air. Any number of gas sources 2 can be used to power a single liquid pressurization system 10. If more than one gas source 2 is used, the gas sources 2 can be connected in parallel, for example, by a manifold that is connected to the liquid pressurization system 10.

In one example embodiment, the cylinder of compressed nitrogen gas has a sufficient volume to power a water-based fire sprinkler system for 10 minutes, which is the operation time for many residential fire sprinkler systems. In other embodiments, for example, a commercial fire sprinkler system, there can be enough of the gas source 2 to power the sprinkler system for 30 minutes. Longer or shorter durations of required sprinkler system operation time may be desired, depending on the particular application or type of hazard that the system 1 is designed to treat. The amount of nitrogen supply to be maintained on site in the gas source 2 can be determined by the pumping duration required (e.g., a chart that can be used to calculate required nitrogen supply based on psi and pumping duration is provided in U.S. Pat. No. 5,979,563, the disclosure of which is hereby incorporated by reference as if set forth in its entirety herein). In the embodiment of a fire sprinkler system, it can be beneficial to test the liquid disbursement system 1 periodically, for instance every 6-12 months, which can consume a portion of the gas source 2. In such embodiments, the amount of nitrogen supply to be maintained in the gas source 2 can be increased to compensate for such periodic testing while still providing enough nitrogen gas to operate the system 1 for the required time duration.

In an example embodiment, the gas source 2 contains 300-400 cubic feet of available nitrogen gas (at a pressure of 40-100 psi) that is compressed to a pressure of 2400 psi. The pressure exiting the gas source 2 can be controlled by a gas regulator (not shown) that can be set to a desired gas flow, for example, in psi.

The liquid source 3 can be any liquid, and in the context of a fire sprinkler system, can be any fire suppressing or extinguishing liquid, for example, water. In the example embodiment of a water sprinkler system, the liquid source 3 can be water from a tank, water from a municipal supply, or any other water source that is provided to the building served by the water sprinkler system.

The liquid delivery system 4 can be any system that delivers liquid from the liquid source 3 to a desired location. For example, in the example embodiment of a water sprinkler system, the liquid delivery system 4 can be a network of interconnected pipes routed throughout a residential or commercial building, and the network of interconnected pipes can terminate in a plurality of sprinkler heads, each sprinkler head adapted to spray water over a desired area. In an example embodiment, each sprinkler head includes a heat sensor that opens a valve to allow water to flow out of the sprinkler system when a target temperature (e.g., 155° F.) is exceeded.

The liquid pressurization system 10 includes a pump 15, a fluid intake line which can be a gas intake line 20 that connects the fluid or gas source 2 to a fluid inlet or gas inlet of the pump 15, a liquid intake line 30 that connects the liquid source 3 to a liquid inlet of the pump 15, a liquid discharge line 40 that connects a liquid outlet of the pump 15 to the liquid delivery system 4, a first sensing line 50 extending from the liquid discharge line 40, and a second sensing line 60 extending between the first sensing line 50 and the gas intake line 20. In this regard, it should be appreciated that the sensing lines 50 and 60 could provide one continuous sensing line, such that the second sensing line 60 is an extension of the first sensing line 50. The discharge line 40 and the liquid delivery system 4 can be referred to as the "discharge side" of the liquid disbursement system 1.

The pump 15 can be powered only by the gas source 2, and thus in certain embodiments does not require any electricity to operate, so that the pump 15 can operate effectively during a power failure.

In an example embodiment, the pump 15 is a Yamada Model NDP-40 double diaphragm pump, commercially available from Yamada America, Inc. in Arlington Heights, Ill. The double diaphragm pump 15 includes a pair of flexible diaphragms that divide the pump housing into a pair of pressure chambers and a pair of pumping chambers. The double diaphragm pump 15 transfers energy from the gas source 2 to the liquid source 3, thereby increasing the pressure in the liquid in the liquid discharge line 40. Specifically, the double diaphragm pump 15 transfers pressure from the gas source 2 to the liquid from the liquid source 3, and each of the two diaphragms 29*a* and 29*b* alternately pumps a portion of the liquid from the liquid source 3 from the liquid intake line 30 into the liquid discharge line 40, while increasing the pressure of the liquid from the liquid source 3. In the example embodiment, the pressure of the liquid from the liquid source 3 is increased by the pump 15 to a level between 40-100 psi, as desired. The double diaphragm pump 15 operates generally in the manner disclosed in U.S. Pat. No. 4,854,832, the disclosure of which is incorporated herein by reference. In the example embodiment wherein the double diaphragm pump 15 is a Yamada Model NDP-40, for example, the double diaphragm pump 15 will not be damaged if it continues to cycle after the liquid source 3 has been consumed or exhausted. The double diaphragm pump 15 can continue to operate even when submerged in liquid (e.g., a flood condition). In some example embodiments, for example, the double diaphragm pump 15 can be a pump from any other manufacturer, and the particular model chosen for the double diaphragm pump 15 can be selected based on the water pressure and rate of water pumping desired.

The double diaphragm pump 15 can include vibration isolation pads 16 disposed on the legs of the double diaphragm pump 15. The vibration isolation pads 16 can reduce noise and vibration during operation of the double diaphragm pump 15.

The gas intake line 20 includes an intake opening 21 that is coupled to the gas source 2, a gas intake sensing line tee 22 connected to a gas intake portion 61 of the sensing line 60, a pilot-driven shut-off valve 23, and a pilot valve 26 for controlling the pilot-driven shut-off valve 23.

The pressure of the gas in the gas intake line 20 is determined by the gas regulator located on the gas source 2 (e.g., a cylinder of compressed nitrogen gas). A user can use the gas regulator located on the gas source 2 to set the pressure of the liquid in the liquid discharge line 40 and the liquid in the liquid delivery system 4. The liquid in the liquid discharge line 40 and the liquid in the liquid delivery system 4 can be within 3 psi of the gas in the gas intake line 20, assuming a small amount of mechanical loss due to inefficiency of the double diaphragm pump 15 and loss in the liquid discharge line 40 and the liquid delivery system 4.

The gas intake sensing line tee 22 is connected to the pilot valve 26 via the gas source portion 61 of the sensing line 60.

The pilot-driven shut-off valve 23 is an air driven shut-off valve. The shut-off valve 23 can isolate the gas source 2 from the double diaphragm pump 15 when the liquid disbursement system 1 is in an idle state. The pilot valve 26 can open and close the shut-off valve 23 when the sensing line 60 detects that the liquid delivery system 4 has been sealed off (e.g., the valves in all of the sprinkler heads have been closed).

The shut-off valve 23 can include an internal piston that is connected to the pilot valve 26. The shut-off valve 23 can be a Val-12 valve commercially manufactured by Norgren, located in Littleton, Colo. The piston can be spring loaded, such that when the gas in the pilot valve 26 is at a substantially equal pressure to (for example, within 3 psi of) the gas in the shut-off valve 23, the piston closes the shut-off valve 23 because the force acting on the piston from the pilot valve 26 along with the spring force exceeds the force acting on the piston from the gas pressure. When the gas in the pilot valve 26 has a lower pressure than (or, for example, a pressure more than 3 psi lower than) the gas in the shut-off valve 23, the piston opens the shut-off valve 23 because the force acting on the piston from the gas pressure exceeds the force acting on the piston from the pilot valve 26 and the spring. In this regard, it should be appreciated that gas is trapped in the sensing lines 50 and 60. Accordingly, the pressure of the liquid in the liquid discharge line 40 is exerted on the gas in the sensing lines 50 and 60, which causes the gas to exert the liquid pressure (less a small factor due to the compressibility of the air) upon the pilot valve 26. Thus, it can be said that the liquid pressure is exerted upon, or sensed by, the pilot valve 26. The particular pressure differential (e.g., 3 psi) that triggers the pilot valve 26 to open or close the shut-off valve 23 can be chosen by the user, depending on the degree of mechanical loss in the double diaphragm pump 15 and performance requirements of the liquid delivery system 4. If desired, the piston 27 can have a greater surface area exposed to the pilot valve 26 and a smaller surface area exposed to the shut-off valve 23 so as to assist in the opening and closing of the shut-off valve 23, it being appreciated that a given pressure applied against a larger surface area will generate a force that is greater than a force generated by a like pressure applied against a smaller surface area.

Otherwise stated, when the liquid pressure applied to the shut-off valve has a predetermined relationship with respect to the gas pressure applied to the shut-off valve 23 from the source 2 (for instance a liquid pressure that is equal to or greater than a predetermined threshold), the shut-off valve remains closed. In accordance with one embodiment, the predetermined threshold can be 3 psi less than the gas pressure. When the liquid pressure does not have the predetermined relationship with respect to the gas pressure (for instance the liquid pressure is less than the predetermined threshold), the shut-off valve 23 opens, and allows the gas source to flow to the gas inlet of the pump 15.

The shut-off valve 23 further acts as a check valve that isolates the double diaphragm pump 15 from the gas source 2 when the liquid disbursement system 1 is in an idle state. The shut-off valve 23 can prevent excess pressure from the double diaphragm pump 15 from damaging the regulator on the cylinder holding the gas source 2.

The liquid intake line 30 connects the liquid source 3 to the inlet (i.e., suction flange) of the double diaphragm pump 15. In the example embodiment of a fire sprinkler system, a head pressure is applied to the liquid source 3, as the double diaphragm pump 15 does not operate in a self-prime mode. The head pressure applied to the liquid source 3 should not exceed 10 psi when used in combination with the double diaphragm pump 15, though it should be appreciated that other pumping mechanisms could be used along with different head pressures applied to the liquid source 3. It should be appreciated in accordance with an alternative embodiment that the pump could be operable in a self-prime mode.

The liquid discharge line 40 includes a sensing line tee 43 connected to the sensing line 50, check valves 42 and 44 for helping to isolate the double diaphragm pump 15 from the gas intake line 20 (via the sensing line 60) and the liquid delivery system 4, and a discharge opening 46 configured to be coupled to the liquid delivery system 4.

In an example embodiment, each of the check valves 42 and 44 are resilient seat check valves. The check valves 42 and 44 can help to prevent false pressure signals from traveling along the sensing line 60 to the pilot valve 26. The check valves 42 and 44 can help to prevent back-siphoning of liquid in the liquid discharge line 40 into the sensing lines 50 and 60. The check valves 42 and 44 can protect the double diaphragm pump 15 from being damaged by gas flowing through the sensing line 60 into the liquid discharge line 40 during the staged start-up of the liquid pressurization system 10.

A liquid flow pulse dampening device can be connected to the liquid discharge line 40 to reduce pulsing of the flow of the liquid in the liquid discharge line 40 and the liquid delivery system 4. The pulsing of the flow of the liquid in the discharge line 40 is due to the alternating actuation of the diaphragms included in the double diaphragm pump 15. An example of a liquid flow dampening device suitable for use in the liquid pressurization system 10 is shown and described in U.S. Pat. No. 5,979,563.

To reduce the pulsing of the flow of the liquid in the discharge side of the liquid disbursement system 1, it can be beneficial to limit the size of the double diaphragm pump 15 to maintain a smoother pumping cycle. In embodiments wherein a liquid flow pulse dampening device is not included, liquid flow rate can meet the pressurized liquid demand in many potential applications, such as a fire sprinkler system, although some pulsing may be present in the liquid flow through the liquid delivery system 4.

In an example embodiment, the hard piping included in the liquid discharge line 40 and the sensing line 50 can be delivered to a user in a "riser" configuration, and installed in the field.

In an example embodiment, an electric liquid flow alarm 41 and a switch, for example, a paddle switch, can be connected to a port within the liquid discharge line 40. The electric liquid flow alarm can provide an audible notification to the user that an electric circuit in the paddle switch has closed, signaling that the pressure in the liquid discharge line 40 has dropped and liquid has begun to flow out of the liquid pressurization system 10 and into the liquid delivery system 4 for eventual discharge, for example, by sprinkler heads included in the liquid delivery system 4.

The sensing line 50 extends from the liquid discharge line 40 and includes a sensing line tee 52 connected to the sensing line 60, and an expansion tank 45 connected to the liquid discharge sensing line tee 52.

The sensing line 60 includes a gas intake portion 61 extending between the gas intake sensing line tee 22 and the pilot valve 26, and extending between the liquid discharge sensing line tee 52 and the pilot valve 26. In an example embodiment, the sensing line 60 each comprise a flexible ¼-inch tube. ***

After the components of the liquid disbursement system 1 are connected or installed as described above, the gas intake line 20, the liquid intake line 30, the liquid discharge line 40, the sensing line 50, and the sensing line 60 can be filled with the gas from the gas source 2 and liquid from the liquid source 3 according to the set-up method as described below.

In an example embodiment, the gas regulator or gas pressure valve connected to the gas source 2 is set to a desired gas flow, for example, in psi. The gas regulator can be set, for example, to a pressure between 40-140 psi, depending on the performance requirements of the liquid disbursement system 1 and/or the structure of the liquid delivery system 4 and the liquid pressurization system 10. A particular gas regulator pressure can be chosen to be slightly higher than the desired pressure for the liquid discharge line 40 and the liquid delivery system 4, in order to compensate for small mechanical losses in the double diaphragm pump 15.

After a desired pressure is set for the gas source 2, a ball valve (not shown) connected to the intake opening 21 can be opened to allow gas from the gas source 2 to fill the gas intake line 20, the liquid discharge line 40, the sensing line 50, and the sensing line 60. The gas from the gas source 2 enters the liquid pressurization system 10 at the gas intake line 20. The gas then travels along the sensing line 60 to the sensing line 50, and the gas travels along the sensing line 50 to reach the liquid discharge line 40.

In an example embodiment, the gas from the gas source 2 is flooded into the liquid pressurization system 10 before any liquid enters the liquid pressurization system 10, so that liquid does not travel along the sensing lines 50 and 60 to the pilot valve 26. It should be appreciated during use that some liquid may travel from the liquid discharge line 40 into the sensing line in order to exert the liquid pressure on the air that is trapped in the sensing lines 50 and 60. If liquid travels through the sensing lines 50 and 60 and reaches the pilot valve 26, control problems could occur, and it may be necessary to empty the liquid out of the liquid pressurization system 10 and restart the set-up method by flooding the system with gas from the gas source 2.

After the liquid pressurization system 10 is filled with gas from the gas source 2, a ball valve (not shown) connected to the liquid intake line 30 can be opened to allow liquid from the liquid source 3 to enter the double diaphragm pump 15. The double diaphragm pump 15 is cycled, resulting in liquid from the liquid source 3 being pumped into the liquid discharge line 40, and from the liquid discharge line 40 into the liquid delivery system 4.

The cycling of the double diaphragm pump 15 will cause water pressure to increase in the liquid discharge line 40, and thus cause the pressure to increase in the sensing lines 50 and 60, and the liquid delivery system 4. When the water pressure, as sensed by the pilot valve 26, reaches a pressure within the selected range (e.g., 3 psi) of the pressure in the gas intake line 20, the shut-off valve 23 will close, thereby cutting off the flow of pressurized gas to the double diaphragm pump 15. Without power (which is provided by pressurized gas from the gas source 2), the double diaphragm pump 15 will stop cycling.

After the gas intake line 20 has been filled with gas from the gas source 2, and after the liquid discharge line 40 and the liquid delivery system 4 has been filled with pressurized liquid that has been pumped through the double diaphragm pump 15, and the pressure in the sensing line 50 has risen to a level within the selected range of the pressure in the gas intake line 20, which has caused the shut-off valve 23 to close, the liquid disbursement system 1 has reached an idle mode or state.

When the liquid disbursement system 1 has reached the idle state, the system 1 has reached an in-service state, wherein the system 1 is ready to supply a pressurized liquid to the liquid delivery system 4 when the pilot valve 26 detects a sufficient drop in pressure in the sensing line 50.

When the liquid disbursement system 1 has reached the idle state and is placed in service, the double diaphragm pump 15 will automatically begin pumping liquid from the liquid source 3 into the liquid discharge line 40 and the liquid delivery system 4 when a pressure differential (in excess of the selected range, for example, 3 psi) between the sensing line 60 and the pressure in the gas intake line 20 is detected by the pilot valve 26.

This pressure differential between the pilot valve 26 and the shut-off valve 23 will cause the pilot valve 26 to detect a sufficient drop in pressure in the liquid discharge line 40 (via the pressure of the sensing line 60), and the shut-off valve 23 will open and allow pressurized gas from the gas intake line 20 to enter the double diaphragm pump 15. The pressurized gas provides power to the double diaphragm pump 15, and the pressurized gas allows the double diaphragm pump 15 to cycle and begin to pump pressurized liquid into the liquid discharge line 40 and the liquid delivery system 4.

The double diaphragm pump 15 will continue to cycle and pump pressurized liquid into the liquid discharge line 40 and the liquid delivery system 4 until the a pressure differential (in excess of the selected range) is no longer detected (by the pilot valve 26) between the sensing line 60 and the gas intake line 20. When the pilot valve 26 no longer detects a pressure differential (for instance, when the sprinkler heads are turned off and liquid pressure amasses in the liquid discharge line 40, and acts against the air or gas in the sensing lines 50 and 60), the shut-off valve 23 will close, thereby isolating the double diaphragm pump 15 from the gas intake line 20. Because the pressurized gas provides power to the double diaphragm pump 15, the isolation of the double diaphragm pump 15 from the gas intake line 20 will cause the diaphragm pump 15 to automatically cease pumping, thereby returning the liquid disbursement system 1 to the idle state.

When the pressure setting at the regulator is increased while the liquid disbursement system 1 is in the idle state, the pressure in the gas intake line 20 will increase, and the pilot valve 26 will detect a pressure differential between the gas intake line 20 and the sensing line 60. When the pressure differential exceeds the selected range (e.g., 3 psi), the shut-off valve 23 will open and deliver pressurized gas to the double diaphragm pump 15. The double diaphragm pump 15 will automatically begin pumping, and the double diaphragm pump 15 will continue pumping until the pressure at the sensing line 60 reaches a pressure within the selected range (e.g., 3 psi) of the pressure in the gas intake line 20. The shut-off valve 23 will then close, and the system 1 will return to the idle state.

When the pressure setting at the regulator is decreased while the liquid disbursement system 1 is in the idle state, the shut-off valve 23 will still remain closed. Therefore, in order to decrease the pressure in the liquid discharge line 40 and the liquid delivery system 4, after decreasing the pressure setting at the regulator, the user should relieve some of the pressure in the liquid discharge line 40, a drainage port (not shown) can be opened in the sensing line 50 or the liquid discharge line 40, until the sensed liquid pressure is reduced to a desired level.

When the liquid disbursement system 1 has reached the idle state and is placed in service, the double diaphragm pump 15 will automatically begin pumping liquid whenever a "demand" for pressurized liquid flow is sensed by the pilot valve 26. There are several types of situations or "demands" that may cause the double diaphragm pump 15 to automatically begin pumping liquid, including, for example, the opening of a sprinkler head connected to the liquid delivery system 4, the opening of a hose or faucet connected to the liquid delivery system 4, or a liquid leak within the liquid delivery system 4. Liquid flow will continue so long as there is a demand, gas flows from the gas source 2, and liquid flows from the liquid source 3.

For example, in the example embodiment of a fire sprinkler system, when one or more sprinkler heads included in the liquid delivery system 4 detects a temperature in excess of a target temperature (e.g., 155° F.), the sprinkler heads will automatically open, and pressurized liquid will flow out of the liquid delivery system 4 through one or more open sprinkler heads. The flowing of liquid out of the liquid delivery system 4 (or this "demand" for liquid flow from the liquid delivery system 4) will cause the pressure to drop in the liquid delivery system 4, the liquid discharge line 40, and the sensing lines 50 and 60. The pressure drop in the sensing line 60 will be sensed by the pilot valve 26, and will cause the shut-off valve 23 to open. The double diaphragm pump 15 will automatically begin to pump pressurized liquid into the liquid discharge line 40, continuing into the liquid delivery system 4, and flowing out of the sprinkler heads.

The liquid flow will continue until either the demand ceases (e.g., the sprinkler heads close due to a fire being extinguished), the gas source 2 becomes exhausted, or the liquid source 3 becomes exhausted. If the sprinkler heads close while the double diaphragm pump 15 is still pumping (thereby ceasing the demand), the pressure in the liquid discharge line 40 will increase, and act upon the air trapped in the sensing lines 50 and 60, until the pilot valve 26 senses that the pressure differential between the sensing line 60 and the gas intake line 20 drops to a predetermined threshold. When the pressure differential reaches the predetermined threshold, the shut-off valve 23 will close and the double diaphragm pump 15 will automatically cease pumping.

Alternatively, if the gas source 2 becomes exhausted, the double diaphragm pump 15 will automatically cease pumping because there will be no power source remaining for the double diaphragm pump 15 to continue pumping. To place the system 1 back into service, the gas source 2 would need to be sufficiently replenished so that there is adequate storage to meet the duration of liquid flow pumping required for the system 1, and the set-up method described above would need to be performed again. If the liquid source 3 becomes exhausted, the double diaphragm pump 15 will continue to pump, but no liquid will flow to the liquid delivery system 4. To place the system 1 back into service, the liquid source 3 would need to be sufficiently replenished.

The example embodiment of a residential or commercial plumbing system can operate in a similar manner as the fire sprinkler system. For example, "demand" for pressurized water can be created by opening a hose or faucet connected to the liquid delivery system 4. When the hose or faucet is opened, pressurized liquid will flow out of the liquid delivery system 4. The flowing of liquid out of the liquid delivery system 4 will cause the pressure to drop in the liquid delivery system 4, the liquid discharge line 40, and the sensing lines 50 and 60, and the double diaphragm pump 15 will automatically begin to pump pressurized liquid into the liquid discharge line 40, continuing into the liquid delivery system 4, and flowing out of the hose or faucet. When the "demand" for pressurized liquid ceases (i.e., a user closes the hose or faucet), the pressure in the liquid discharge line 40 will increase until the pilot valve 26 senses that the pressure differential between the sensing line 60 and the gas intake line 20 drops to the predetermined threshold, and the double diaphragm pump 15 will automatically cease pumping. Alternatively, if the gas source 2 becomes exhausted while the hose or faucet is still open, the double diaphragm pump 15 will automatically cease pumping because there will be no power source remaining for the double diaphragm pump 15 to continue pumping. If the liquid source 3 becomes exhausted, the double diaphragm pump 15 will continue to pump, but no liquid will flow to the liquid delivery system 4.

It is also possible to create a pressure differential between the sensing line 60 and the gas intake line 20 due to unanticipated leaking of liquid out of one or more of the components of the liquid discharge line 40 or the liquid delivery system 4. This leaking from the discharge side of the liquid disbursement system 1 will reduce the pressure in the sensing line 60 that is sensed by the pilot valve 26, effectively creating a "demand" for pressurized liquid. When the pressure differential between the sensing line 60 and the gas intake line 20 reaches the selected range, the shut-off valve 23 will open, and the double diaphragm pump 15 will automatically begin to pump pressurized liquid into the liquid discharge line 40. If the leak is slow, a small amount of pumping from the double diaphragm pump 15 may sufficiently increase the pressure sensed by the pilot valve 26, and the shut-off valve 23 will close, causing the double diaphragm pump 15 to automatically cease pumping.

Such leaking from the discharge side of the system 1 may cause periodic cycling of the double diaphragm pump 15 to maintain the desired pressure in the discharge side of the system 1, which may partially or fully deplete the gas source 2 over a period of time, potentially leaving the system 1 with an inadequate supply of the gas source 2 to put out a fire, for example. To alert a user to unexpected periodic cycling of the double diaphragm pump 15 due to a leak, the gas exhaust port 17 (shown in FIG. 4A) can be equipped with a gas-driven audible alarm device (not shown). Such an alarm device will sound an audible alarm when gas flows out of the double diaphragm pump 15 through the gas exhaust port 17 during cycling of the pump 15, thereby alerting a user to the possibility of a leak. Because the gas source 2 serves as the energy source for the double diaphragm pump 15, it can be beneficial to the user to carefully leak-check all connections in the liquid disbursement system 1.

Figure 4A:
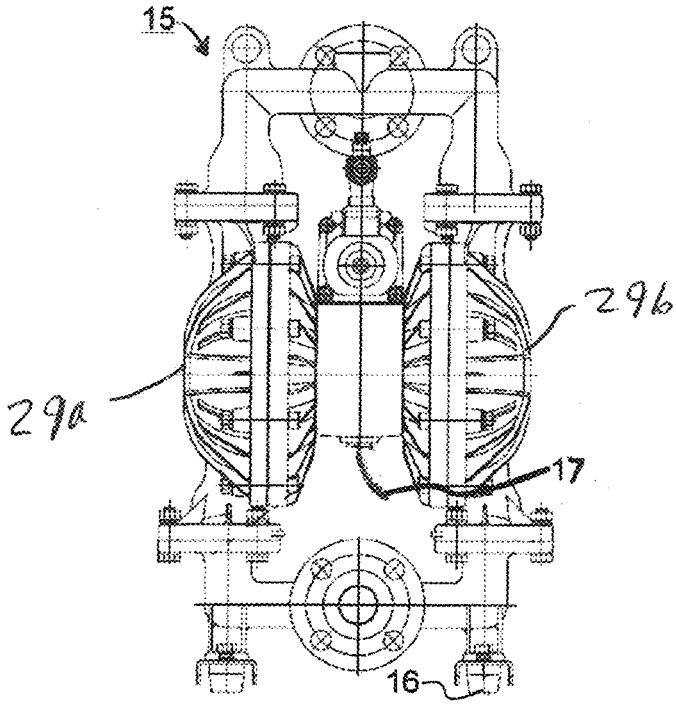
FIG. 4A is a side elevation view of a pump suitable for use in the pump system depicted in FIG. 2.
Figure 4B:
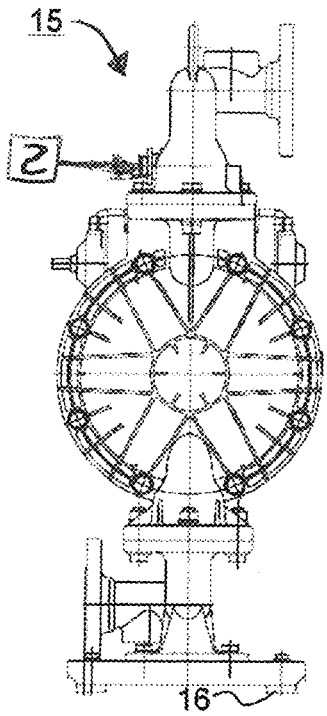
FIG. 4B is an end elevation view of the pump depicted in FIG. 4A.

Referring now to FIGS. 4A and 4B, the double diaphragm pump 15 can further include vibration isolation pads 16 disposed on the legs of the double diaphragm pump 15, and a gas exhaust port 17 for permitting gas from the gas source 2 to exit the double diaphragm pump 15 after the gas is used to actuate the diaphragms included in the double diaphragm pump 15.

Figure 5:
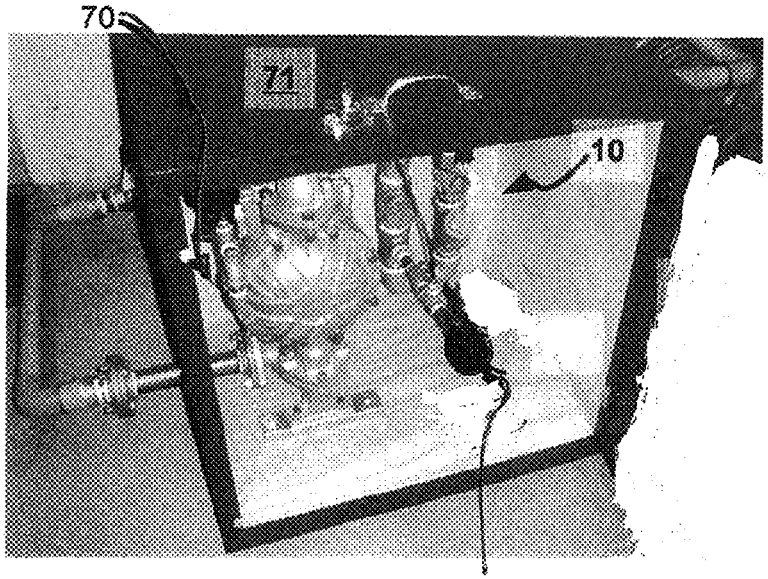
FIG. 5 is a perspective view of the pump system depicted in FIG. 2, disposed in an enclosure.

Referring now to FIG. 5, the liquid disbursement system 1 can further include a housing that defines an enclosure 70 that contains the liquid pressurization system 1. The housing 71 can provide or restrict selective access to the enclosure 70 and the liquid pressurization system 10. The housing 71 is illustrated with one wall removed so as to illustrated the liquid pressurization system 10. The enclosure 70 can have any shape, including, for example, a box-shape, or any other shape that can provide protection and can restrict access to the liquid pressurization system 10. Part of the housing 71 can be lifted upwards and removed from the base of the housing in order to provide selective access to the system 10.

The gas and liquid plumbing components described herein as included in the liquid disbursement system 1 can be constructed from any material or combination of materials, including, for example, steel, aluminum, copper, zinc, plastic, wire mesh, composite, or any other material that is known in the art to be suitable for gas or liquid plumbing.

The foregoing description is provided for the purpose of explanation and is not to be construed as limiting the invention. While the invention has been described with reference to several embodiments or several methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes can be made without departing from the scope and spirit of the invention as defined by the appended claims.

Furthermore, any features of one described embodiment can be applicable to the other embodiments described herein.

What is claimed:

1. A liquid disbursement system configured to selectively provide a source of pressurized liquid to a desired location in the absence of electricity, the liquid disbursement system comprising:

a pump having a gas inlet, a liquid inlet, and a liquid outlet;

a source of liquid coupled to the liquid inlet of the pump;

a liquid discharge line coupled to the liquid outlet of the pump, the liquid discharge line configured to supply liquid from the liquid outlet of the pump to a liquid delivery system;

a source of gas coupled to the gas inlet of the pump via a gas intake line, the gas intake line including a valve disposed between the source of gas and the pump, the valve receiving a gas pressure from the source of gas, the valve configured to open so as to supply the gas to the pump so as to cause the pump to expel the liquid from the liquid inlet out the liquid outlet; and a sensing line connected between the liquid discharge line and the gas intake line, the sensing line applying a liquid pressure from the liquid discharge line to the valve, such that the valve is open when the applied liquid pressure has a predetermined relationship with respect to the gas pressure, and is closed when the applied liquid pressure does not have the predetermined relationship with respect to the gas pressure.

2. The liquid disbursement system as recited in claim 1, wherein the predetermined relationship comprises a pressure differential between the applied liquid pressure and the gas pressure.

3. The liquid disbursement system as recited in claim 1, wherein the valve opens so as to allow the gas to flow to the gas inlet of the pump when the liquid pressure drops below a predetermined threshold.

4. The liquid disbursement system as recited in claim 3, wherein the valve closes so as to prevent the gas from flowing to the gas inlet of the pump when the liquid pressure is above the predetermined threshold.

5. The liquid disbursement system as recited in claim 4, wherein the liquid pressure is configured to fall below the predetermined threshold when the liquid delivery system is opened so as to allow the liquid to flow from the liquid discharge line and out of the liquid delivery system.

6. The liquid disbursement system as recited in claim 1, wherein the liquid pressure is exerted on gas disposed in the sensing line, such that the gas acts against the valve at a pressure indicative of the liquid pressure.

7. The liquid disbursement system as recited in claim 6, wherein the liquid discharge line further comprises a check valve disposed between the sensing line and the pump, the check valve configured to isolate the liquid outlet of the pump from receiving liquid from the liquid discharge line.

8. The liquid disbursement system as recited in claim 6, wherein the liquid discharge line further comprises a second check valve disposed between the sensing line and the liquid delivery system.

9. The liquid disbursement system as recited in claim 6, wherein the sensing line comprises a sensing line tee having an outlet that is in fluid communication with an expansion tank.

10. The liquid disbursement system as recited in claim 1, wherein the pump is a double-diaphragm pump configured to pump the liquid from the liquid outlet to the liquid delivery system.

11. The liquid disbursement system as recited in claim 1, wherein the liquid pressure is applied to the valve via air disposed in the sensing line.

12. A liquid disbursement system configured to selectively provide a source of pressurized liquid to a desired location in the absence of electricity, the liquid disbursement system comprising:

a pump having a fluid inlet, a liquid inlet, and a liquid outlet, the pump being configured to pump liquid from the liquid inlet out the liquid outlet;

a source of liquid coupled to the liquid inlet of the pump;

a source of fluid coupled to the fluid inlet of the pump, the source of fluid having a pressure operable to cause the pump to pump the liquid from the liquid inlet out the liquid outlet;

a liquid delivery system coupled to the liquid outlet of the pump via a liquid discharge line;

a sensor disposed between the source of fluid and the fluid inlet of the pump, the sensor configured to selectively prevent the fluid pressure from being applied to the fluid inlet of the pump, and allow the fluid pressure to be applied to the fluid inlet of the pump based on whether the liquid is in the liquid discharge line at a predetermined pressure.

* * * * *